US005755115A

United States Patent [19]

Manley

[11] Patent Number: 5,755,115

[45] Date of Patent: May 26, 1998

[54] CLOSE-COUPLING OF INTERREBOILING TO RECOVERED HEAT

[76] Inventor: David B. Manley, 11480 Cedar Grove Rd., Rolla, Mo. 65401

[21] Appl. No.: 593,617

[22] Filed: Jan. 30, 1996

[51] Int. Cl.[6] ..... F25J 1/00

[52] U.S. Cl. ..... 62/620; 62/630

[58] Field of Search ..... 62/620, 630

[56] References Cited

U.S. PATENT DOCUMENTS

| | | | |
|---|---|---|---|
| 2,277,387 | 3/1942 | Carney . | |
| 2,327,643 | 8/1943 | Houghland . | |
| 2,487,147 | 8/1949 | Latchum, Jr. . | |
| 2,509,044 | 5/1950 | Patterson | 62/620 |
| 2,666,019 | 1/1954 | Winn et al. . | |
| 3,902,329 | 9/1975 | King, III et al. | 62/630 |
| 4,251,249 | 2/1981 | Gulsby . | |
| 4,277,268 | 7/1981 | Spanler, Jr. . | |
| 4,285,708 | 8/1981 | Politte et al. . | |
| 4,705,549 | 11/1987 | Sapper . | |
| 4,726,826 | 2/1988 | Crawford et al. . | |
| 5,152,148 | 10/1992 | Crum et al. . | |

OTHER PUBLICATIONS

P.C. Wankat et al, "Two–Feed Distillation: Same–Composition Feeds with Different Enthalpies", Industrial and Engineering Chemistry Research, vol. 32, No. 12, pp. 3061–3067, 1993.

*Primary Examiner*—Ronald C. Capossela

[57] ABSTRACT

The present invention is an improvement in distillation column interreboiling. Previously, hot bottoms streams could be used to heat interreboilers, although heat recovery was limited by approach temperatures of a stream losing sensible heat to a stream gaining sensible heat and heat of vaporization. The present invention expands the number of stages between the draw and return stages for an interreboiler, thus increasing the heat recovery from the bottom stream and reducing hot utilities to the reboiler, among other important advantages. The present invention is shown for NGL deethanization.

17 Claims, 6 Drawing Sheets

CLOSE-COUPLING OF INTERREBOILING TO RECOVERED HEAT

BACKGROUND OF THE INVENTION

The present invention relates to interreboiling of stripping sections.

About 4.8 MM barrels per day (BPD) of natural gas liquids (NGL) are produced worldwide and about 1.75 MM BPD are produced in the United States ("World's Gas Processing Growth Slows; U.S., Canada Retain Greatest Share", Oil & Gas Journal, Pages 48–108, Jun. 13, 1994). Raw NGL mix is fractionated to produce ethane, propane, isobutane, normal butane, and natural gasoline for downstream processing and end product consumption. Typical feed and product compositions and conditions are given in Table 4. Conventional fractionation technology is reviewed elsewhere (James, J. L. and Ching-Shien, W., "Natural Gas Liquids", Process Economics Program, Report #135, SRI International, Menlo Park, Calif., 1979).

About 75M Btu/bbl of reboiler duty are required for conventional fractionation (see James et al article above); and, at $2.00 per MMBtu, this amounts to about $0.15 per bbl which is a significant portion of the processing profit margin. Consequently, there is an economic incentive to reduce the energy consumed for the fractionation of natural gas liquids. This incentive is augmented by reductions in the associated cooling and waste generation costs. If the reductions in energy consumption are the result of improved process thermodynamic efficiency, then there may also be associated capital and maintenance cost reductions which contribute to the economic incentive to pursue such reductions in energy consumption.

U.S. Pat. No. 2,487,147 describes a two column separation of methane and ethane from condensate. Part of the condensed overhead of a second column fractionating the bottoms product of a first column is used to "load up" the first column so as to maintain column pressure. The column pressure is very high.

U.S. Pat. No. 2,666,019 describes a two column separation of methane and ethane from heavier hydrocarbons. A high pressure stripper is partly reboiled directly with compressed overhead vapor from a lower pressure column being refluxed with the bottoms of the high pressure stripper. The high pressure stripper also is reboiled by indirect heat exchange with feed to the process, the feed preferably being effluent from a catalytic reformer. The lower pressure column also receives reflux from its own condensed overhead.

U.S. Pat. No. 2,277,387 describes a deethanizer for stabilizing gasoline, wherein an ever increasing pressure gradient is established from the bottom stage of the fractionation device to its top stage. It was pointed out that other columns separate components due to differences in temperature from stage to stage, where in this patent, equilibrium conditions change based on change in pressure.

U.S. Pat. No. 2,327,643 describes a two column method for separating close boiling components. A first column is used to generate a bottoms stream which is split, wherein part of the bottoms stream is further separated in the second column. Condensed overhead from the second column and the second part of the bottoms product of the first column are combined and flashed to provide a heat sink stream for condensing the overhead vapor stream from the first column. The resulting vapor stream is compressed and fed to the bottom of the first column to partially provide reboiling for that column.

U.S. Pat. No. 4,251,249 describes a single column, split feed deethanizer. The feed to the column is separated by cooling, heating and compression before feeding to the column.

U.S. Pat. No. 4,277,268 describes a two pressure depropanizer. A rectification section is maintained at substantially higher pressure than the stripping section. The column pressures are limited to those for which the temperature and heat load of rectification section overhead vapor stream condensation may be matched entirely with the temperatures and heat load of the reboiling required in the stripping section.

U.S. Pat. No. 4,285,708 describes a two column deethanization of methane and ethane from heavier components. The process feed is split into two portions. A first portion is partly condensed and fed to a stripper whose bottom product is gasoline range material. The overhead from the stripper is fed to a deethanizer along with the other portion of the process feed. Having performed stripping outside of the deethanizer, it is described that cold utilities are reduced for the deethanization.

U.S. Pat. No. 4,705,549 describes a two column deethanizer wherein a condensed portion of the feed stream is fractionated in a higher pressure column. The condensed portion of the overhead vapor of that higher pressure column is stripped in a lower pressure column with the expanded vapor portion of the system feed. An auto-refrigeration effect occurs in the lower pressure column upon stripping of the lighter components.

U.S. Pat. No. 4,726,826 describes splitting the flow of a gaseous hydrocarbon feed and using the condensed part of the feed as an absorbing medium for countercurrent contact with the other part of the feed. The condensed portion of the feed is thereby stripped of its lighter components. The concept is similar to that of U.S. Pat. No. 5,152,148.

U.S. Pat. No. 5,152,148 describes using the entire depropanizer bottoms stream to reflux a deethanizer in conjunction with a partially condensed vapor overhead stream from the deethanizer. Only air cooling is used for condensing vapor streams. Propane recovery depends primarily on absorption of propane into the propane-lean bottom stream of the depropanizer.

An article by P. C. Wankat et al, "Two-Feed Distillation: Same-Composition Feeds with Different Enthalpies", Industrial and Engineering Chemistry Research, Volume 32, Number 12, Pages 3061–7, 1993, describes the improvement in efficiency for some fractionation columns whose feed has been split to be fed to higher or lower column trays depending on the lower or higher heat content, respectively.

SUMMARY OF THE INVENTION

The present invention is an improvement in partial interreboiling of NGL fractionation columns or zones, especially as applied to deethanizers and depropanizers. Specific applications of the partial interreboiling improvement may be made to complex column relationships for deethanization and depropanization as well as the less complex systems presented herein.

When fractionally distilling a liquid to produce two products of different composition the thermodynamic driving force in a single pressure column is the latent heat of vaporization which cascades down in temperature from the reboiler to the condenser. However, the associated sensible heat necessary to cool the feed to the condenser temperature and heat the feed to the reboiler temperature is not used for separation and may be recovered through the use of interreboilers. This heat effect is particularly significant when the feed contains significant amounts of non-key components such as butanes and gasoline in the feed to a conventional NGL deethanizer distillation column.

The present invention has obtained an improvement over prior art interreboilers which are heated with a cooling of a bottoms liquid product stream. It is well known that the return of a partly vaporized liquid sidedraw should be made as close to the draw tray as possible to reduce fractionation inefficiency on the intervening trays. It is strongly taught in the prior art, with the exception of the above references specifically obtaining absorption-type effects for condensed streams fed to a rectification section, to return partly vaporized interreboiler streams at the most 2 to 3 trays, or an equivalent packed section, from the draw tray. Previously, there has been no benefit realized from increasing the number of trays between the draw tray of a partial interreboiler and its return tray. The present invention has discovered that benefit, shown graphically in the specific examples below. A dramatic improvement in heat recovery and reduction in hot utilities by auto-reboiling is obtained by proper choice of the draw and return trays for a partial interreboiler heated with liquid bottom product streams.

Several stages, preferably about 7 theoretical stages in the specific examples below, are used in between the stripping section draw tray and the return tray located below it, thereby obtaining recovery of more sensible heat from the hot bottoms stream. In addition, the temperature of the draw tray at which the interreboiler draw is taken may be significantly reduced (i.e., the draw tray may be higher in the stripping section), the process flows through the interreboiler will be significantly reduced and the vapor and liquid traffic in the column section between the draw tray and return tray for the interreboiler is also significantly reduced. One result will be that the temperature range required for interreboiling will be reduced and the capacity of an existing, prior art column will be increased.

The availability of lower temperature ranges for interreboiling now makes possible the heating of more than one column interreboiler with column bottoms product liquid. One of the specific examples of the operation of the present invention includes two partial interreboilers for an NGL deethanizer heated with the bottoms stream from that column. The reduction in fractionation efficiency due to reduced internal reflux on the trays of the column between the draw and return trays of the partial interreboiler of the present invention is sufficiently offset by the reduction in hot utilities and vapor and liquid traffic in the column to justify addition of more trays if they are needed.

DETAILED DESCRIPTION OF THE INVENTION

Figure 1A:
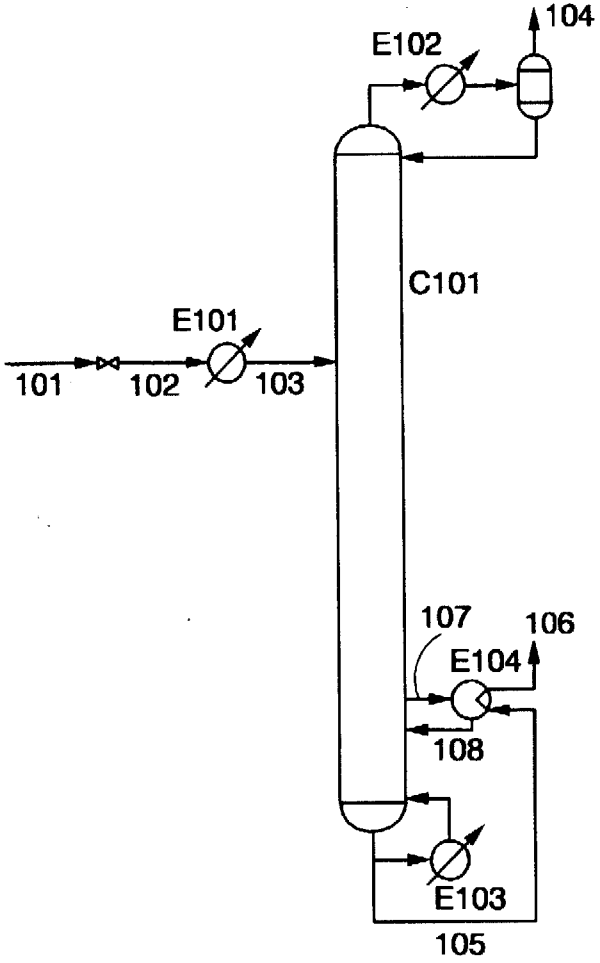
Figure 1A Prior Art
FIG. 1A is a prior art deethanizer for NGL incorporating a partial interreboiler heated with the bottoms liquid product stream. The draw and return stages for the partial interreboiler are shown as the same stage. For this figure and other figures representing process equipment, it is understood that certain equipment such as valves and pumps may be required for operation of the process, although such equipment is not shown in the figures for simplicity.

FIG. 1A shows a typical NGL deethanizer distillation column, column C101, separating ethane from propane in the presence of butanes and gasoline. Other equipment significant to the present invention in FIG. 1A is exchangers E101 (feed stream heater), E102 (condenser for column C101), E103 (reboiler for C101 using hot utilities) and E104 (a process to process interreboiler). The process streams of FIG. 1A are streams 101/102/103 (column C101 feed streams), 104 (the overhead vapor product stream of column C101), 105/106 (the bottom liquid product streams of column C101) and 107/108 (draw and return streams of exchanger E104).

For the columns in the following descriptions, the term "stages" will mean theoretical stages, and numbering of the stages will be from the top stage of the column to the bottom stage. Tray or packed section efficiencies may sometimes by quite high, such that the number of actual trays or height of packed sections will approach the theoretical value. For the purpose of evaluating the actual trays or height of packed sections between a draw and return tray for the present invention, the number of actual trays or the height of the packed section between the draw and return trays can equal the theoretical stage value or be much higher. Twenty theoretical stages are required in column C101. The feed stream enters on stage 9. The draw stage for the partial interreboiler is on stage 16 and the return stage is stage 16.

Figure 1B:
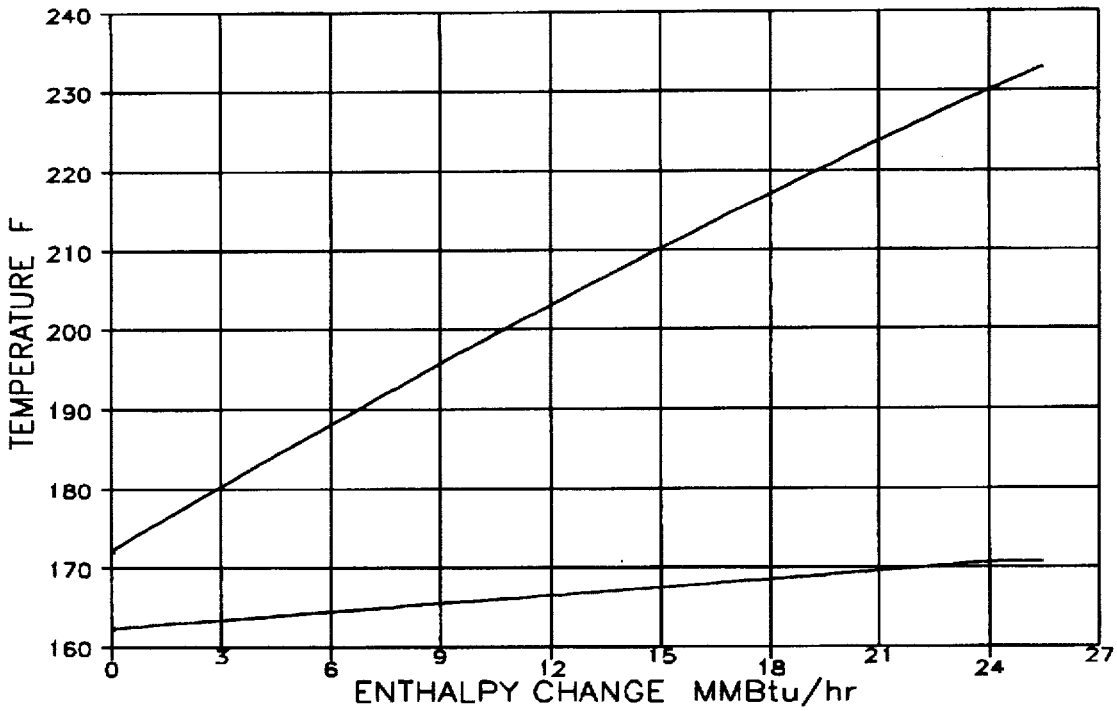
FIG. 1B is a graphical plot of the composite heating and cooling curves for the process streams used in the partial interreboiler shown in FIG. 1A.
Figure 1C:
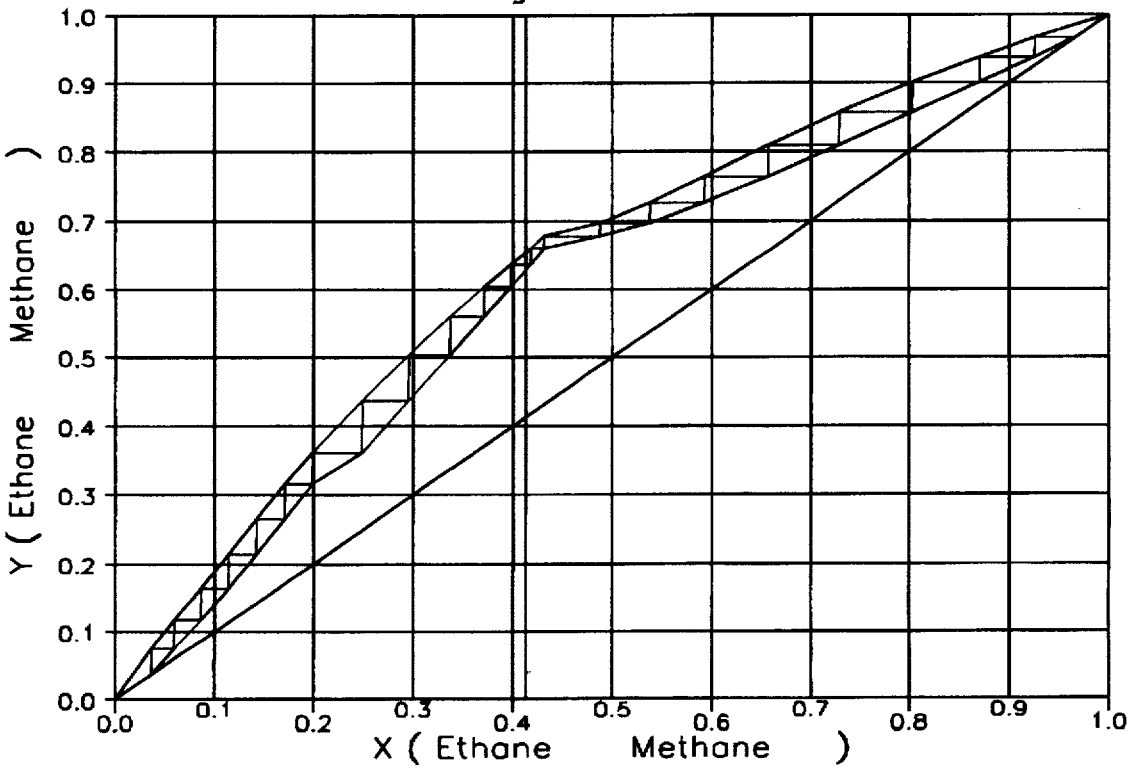
FIG. 1C is a McCabe-Thiele diagram of the light key component formed from ethane and methane for the NGL deethanizer shown in FIG. 1A.

Table 1 gives compositions and conditions for the process streams in FIG. 1A, as well as the duties of the above heat exchangers. Column C101 is operated at about 450 psia to reduce refrigeration utilities cost for the condenser, E102. The hot bottoms product, stream 105, is cooled in an interreboiler, exchanger E104, which recovers sensible heat from stream 105. For a 100M barrel per day (BPD) feed, stream 103, at its bubble point, about 25.5 MMBtu/hr can be recovered in exchanger E104 from stream 105 to stream 108, which reduces the reboiler duty contributed by hot utility in E103 to about 72.7 MMBtu/hr. In comparison with an NGL deethanizer without the interreboiler, the prior art deethanizer just described with an interreboiler reduces hot utility by 26%. FIG. 1B shows the heating and cooling curves for the bottoms product/interreboiler heat exchanger, exchanger E104, which is limited by the 10° F. minimum approach temperature. FIG. 1C shows a McCabe-Thiele diagram for the interreboiled deethanizer with a discontinuity in the slope of the operating line at the interreboiler stage. For this conventional design the amount of sensible heat which may be recovered from the hot bottoms product is limited by the approach temperature in the conventional interreboiler. The interreboiler, exchanger E104, reduces the required column diameter for a limited distance below its return tray location because the internal vapor and liquid traffic in the column are reduced in that region.

It has been discovered that by requiring more theoretical stages than disclosed in the prior art between the interreboiler draw and return stages, that the draw temperature can be significantly reduced without increasing the total interreboiler and reboiler duty. Increasing the number of stages between draw and return stages lowers the temperature to which the hot bottoms product may be cooled, increases the interreboiler duty, and reduces the reboiler duty. Since only part of the liquid from the column withdrawal stage is fed to the interreboiler it is termed a "partial" interreboiler.

Figure 2A:
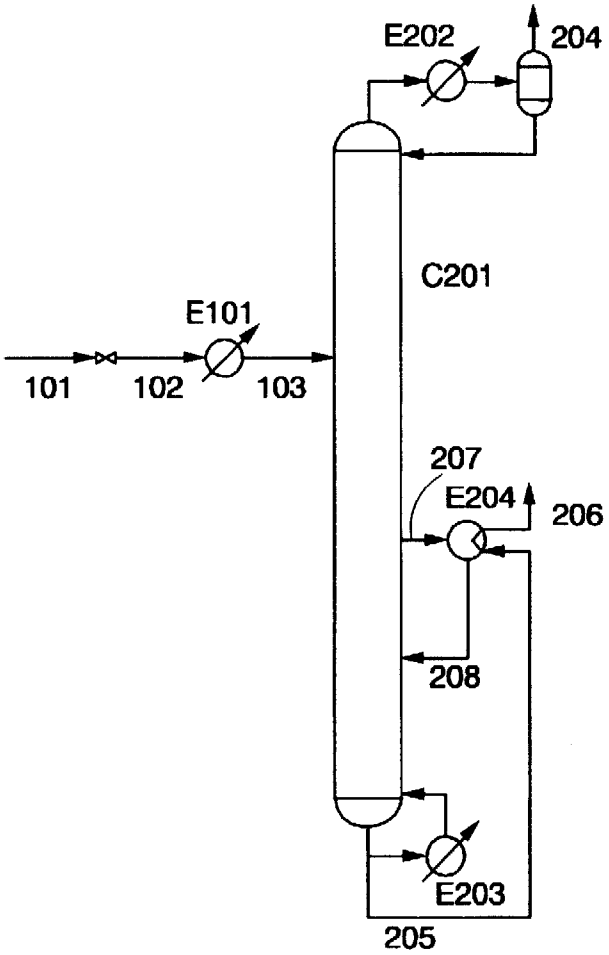
FIG. 2A is a deethanizer for NGL according to the present invention. A partial interreboiler is incorporated with several trays between the draw and return trays.

FIG. 2A shows an NGL deethanizer, column C201, according to the present invention, separating ethane from propane in the presence of butanes and gasoline. Other equipment significant to the present invention in FIG. 2A are exchangers E101 (feed stream heater), E202 (condenser for column C201), E203 (reboiler for column C201 using hot utilities) and E204 (a process to process partial interreboiler). The process streams of FIG. 2A are streams 101/102/103 (column C201 feed streams), 204 (the overhead vapor product stream of column C201), 205/206 (the bottom liquid product streams of column C201) and 207/208 (draw and return streams of exchanger E204). Twenty-three theoretical stages are required in column C201. The feed stream enters on stage 9. The draw stage for the partial interreboiler is on stage 13 and the return stage is stage 20.

Figure 2B:
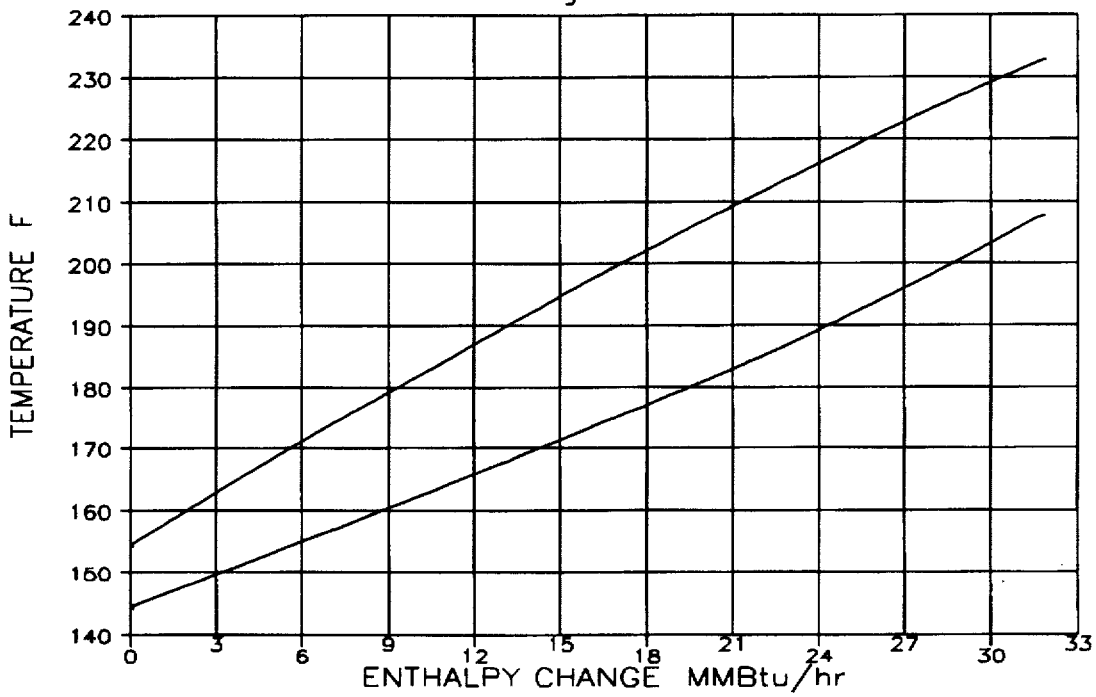
FIG. 2B is a graphical plot of the composite heating and cooling curves for the process streams used in the partial interreboiler shown in FIG. 2A.

Conditions and compositions for the above streams are given in Table 2, as well as duties for the above heat exchangers. The heat recovered in the partial interreboiler, exchanger E204, to stream 208 from the cooling of the hot bottoms product stream, stream 205, is about 31.9 MMBtu/hr. The amount of hot utility required in the reboiler, exchanger E203, is about 66.1 MMBtu/hr, or about 33% of the total hot utility required as compared with a deethanizer without a partial interreboiler. The recovery of heat from the hot column bottoms product is about 7% higher for this embodiment of the present invention than in the conventional case described for FIG. 1A. The heating and cooling curves for the bottoms product/partial interreboiler heat exchanger are shown in FIG. 2B, which is also limited by a 10° F. minimum approach temperature.

Figure 2C:
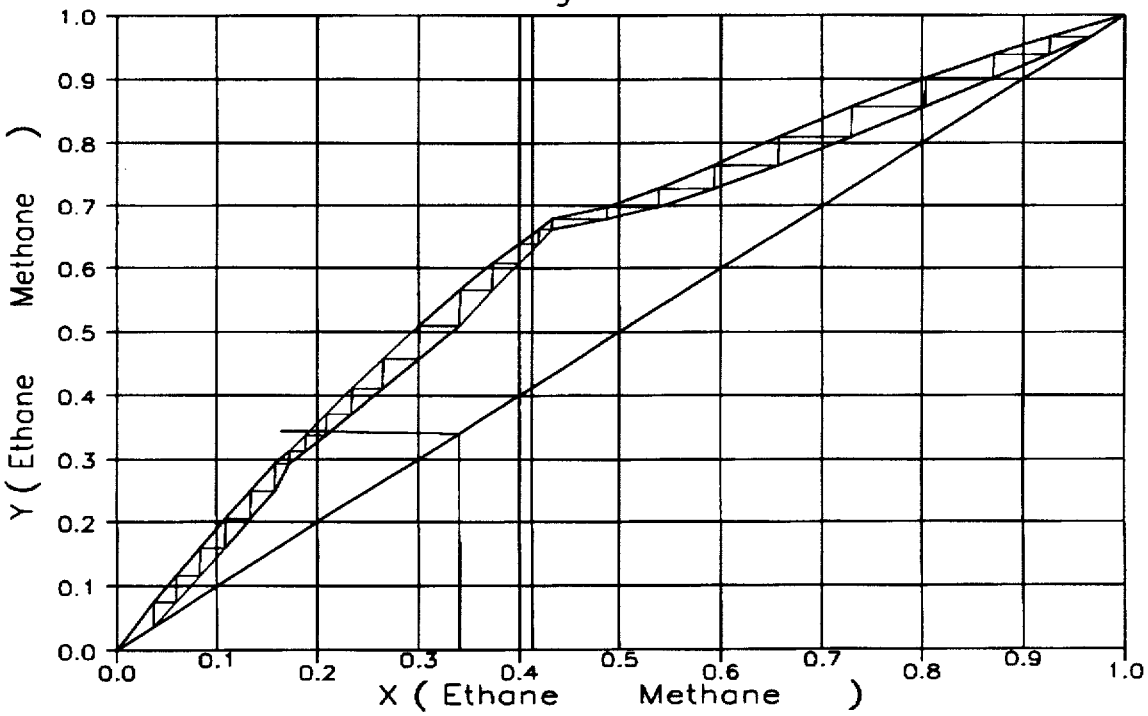
FIG. 2C is a McCabe-Thiele diagram of the light key component formed from ethane and methane for the NGL deethanizer shown in FIG. 2A.

FIG. 2C shows a McCabe-Thiele diagram for the partially interreboiled deethanizer with a discontinuity in the slope of the operating line at the interreboiler stage. However, the size of the discontinuity in the diagram represented by the stripping section is significantly reduced in comparison with the conventional case shown in the diagram of FIG. 2B. Overall, more equilibrium stages are required in the partially interreboiled case; but, because the column liquid traffic is reduced between the partial intercondenser withdrawal and feed stages, the column diameter is reduced. And, the diameter of the column below the partial interreboiler is additionally reduced in comparison with the conventional case because more heat has been shifted from the reboiler to the interreboiler. The material flow through the partial interreboiler is also significantly reduced in comparison to the conventional interreboiler which reduces the cost of the heat exchanger.

Figure 3A:
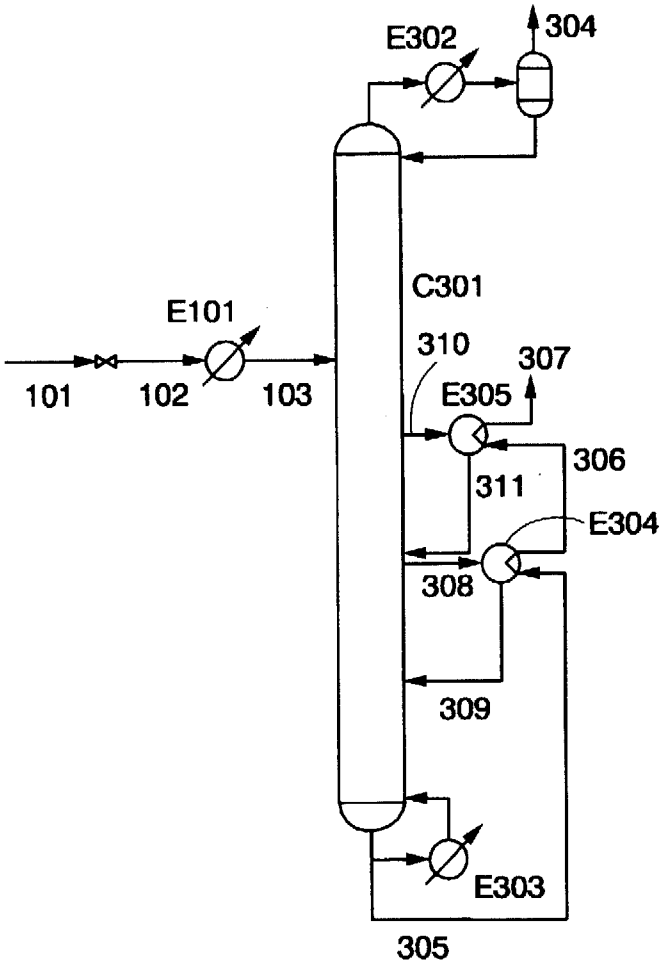
FIG. 3A is a deethanizer for NGL according to the present invention. Two partial interreboilers are incorporated with several trays between the draw and return trays of the individual interreboilers, although the return tray of an upper partial interreboiler is the same as the draw tray of a lower partial interreboiler.

FIG. 3A shows an NGL deethanizer, column C301, according to the present invention, separating ethane from propane in the presence of butanes and gasoline with two partial interreboilers in series exchanging heat with the hot bottoms product. Other equipment significant to the present invention in FIG. 3A are exchangers E101 (feed stream heater), E302 (condenser for column C301), E303 (reboiler for column C301 using hot utilities), E304 (a process to process partial interreboiler) and E305 (a process to process partial interreboiler). The process streams of FIG. 3A are streams 101/102/103 (column C301 feed streams), 304 (the overhead vapor product stream of column C301), 305/306/307 (the bottom liquid product streams of column C201), 308/309 (draw and return streams of exchanger E304) and 310/311 (draw and return streams of exchanger E305). Twenty-eight theoretical stages are required in column C201. The feed stream enters on stage 9. The draw stage for the lower partial interreboiler, exchanger E304, is on stage 16 and the return stage is stage 23. The draw stage for the upper partial interreboiler, exchanger E305, is on stage 9 and the return stage is stage 16.

Figure 3B:
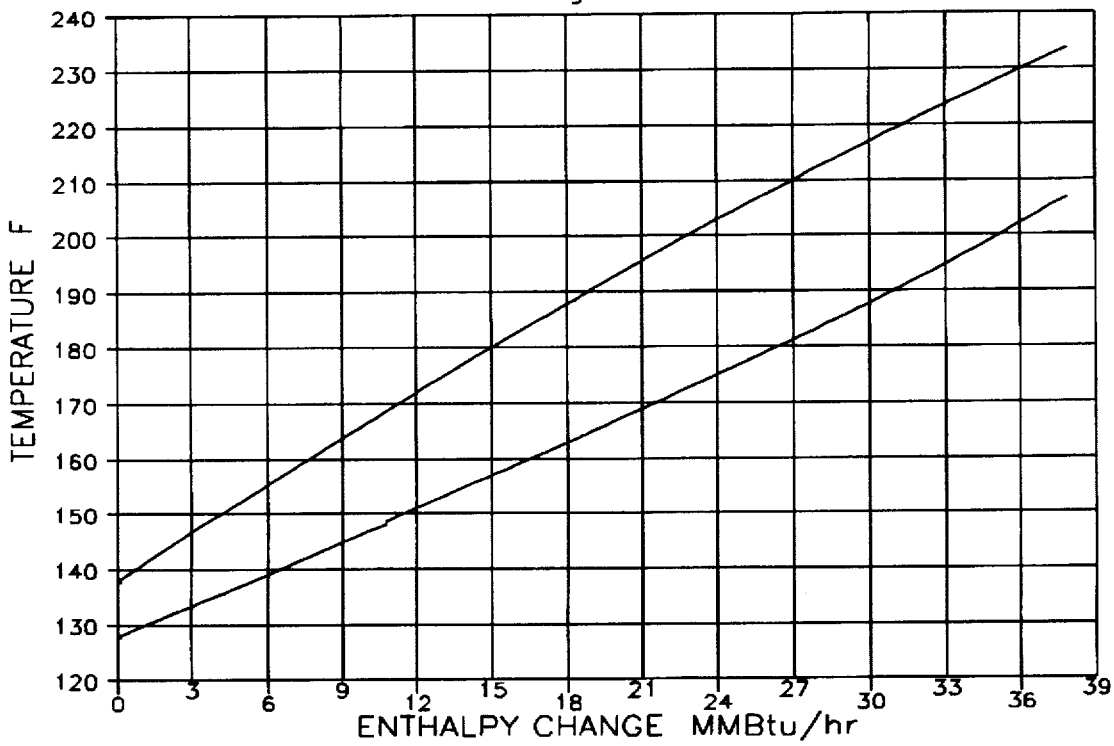
FIG. 3B is a graphical plot of the composite heating and cooling curves for the process streams used in the partial interreboilers shown in FIG. 3A.
Figure 3C:
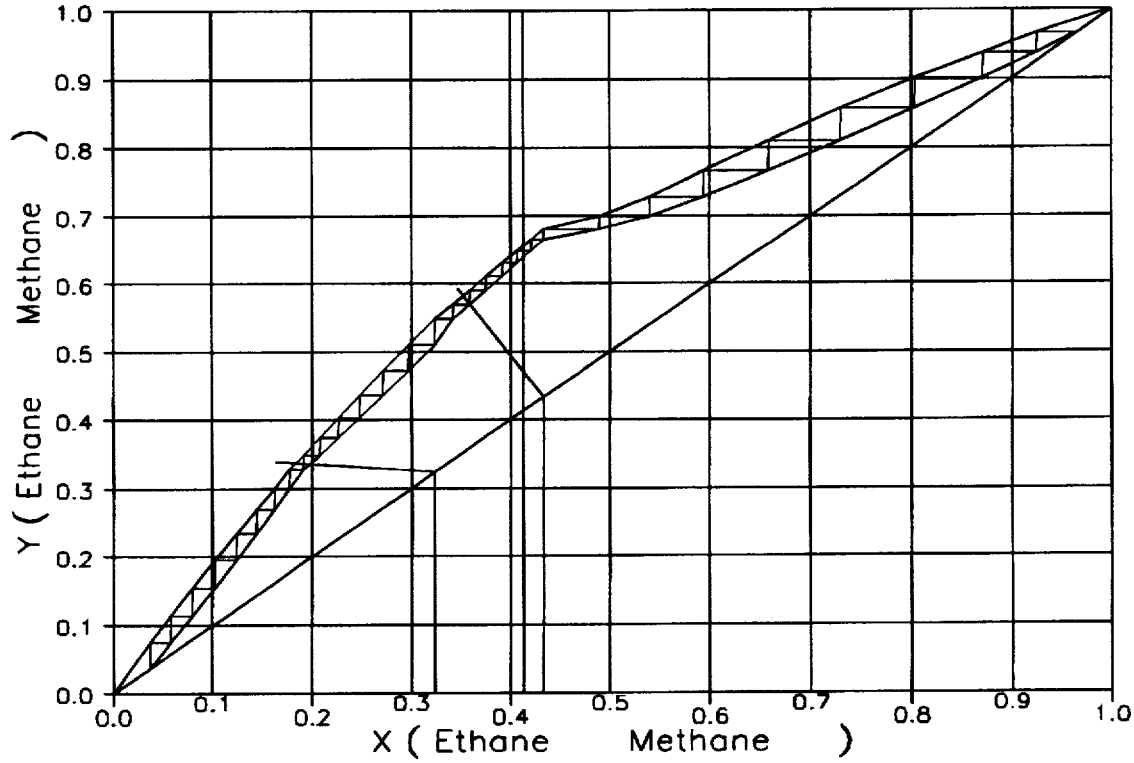
FIG. 3C is a McCabe-Thiele diagram of the light key component formed from ethane and methane for the NGL deethanizer shown in FIG. 3A.

Conditions and compositions for the above streams are given in Table 3, as well as duties for the above heat exchangers. The heat recovered in the partial interreboilers, exchangers E304 and E305, to streams 309 and 311 respectively, is collectively about 37.9 MMBtu/hr. The amount of hot utility required in the reboiler, exchanger E303, is about 60.2 MMBtu/hr or about 39% of the total hot utility required as compared with a deethanizer without a partial interreboiler. The recovery of heat from the hot column bottoms product is about 13% higher for this embodiment of the present invention than in the conventional case described for FIG. 1A. The composite heating and cooling curves for the bottoms product/partial interreboiler heat exchangers are shown in FIG. 3B which is again limited by the 10° F. minimum approach temperature. FIG. 3C shows a McCabe-Thiele diagram for the twice partially interreboiled deethanizer showing the relatively closely matched operating and equilibrium lines indicating the thermodynamic efficiency of the design.

The temperature range for each partial interreboiler is limited by the dew point of its feed since the sensible heat of superheated vapors is relatively small. As a result partial interreboilers are particularly effective for distillation columns with wide boiling key components or with significant amounts of higher boiling non-key components such as in the NGL deethanizer application described above.

A partial interreboiler may be heated by a source other than the column bottoms product, however the thermodynamic advantages of reduced interreboiler draw temperature, reduced column diameter, and reduced material flow through the interreboiler are still obtained with partial interreboiler heating from other sources.

Partial intercondensers and distillation columns with two feeds of the same composition but different enthalpies have been described in the prior art. However, partial interreboilers heated with column bottoms with an increased number of stages between the draw and return stages have not been described previously. The improved close-coupling of the cooling and heating curves of the hot bottoms product and the vaporizing partial interreboiling stream is quite apparent upon inspection of the heating and cooling curves for the prior art interreboiler and those of the present invention. Although it is a preferable goal to improve efficiency by more closely matching or coupling the heating and cooling curves, a goal long sought by many specialists in energy analysis, there are a multitude of innovative design options that must be made before such a goal may be obtained. The present invention is just such an advance in the art.

The recovery of heat to distillation and absorption column interreboiling is presented in several prior art processes. The present invention may be advantageously be applied to those interreboiled processes, such as lean oil absorption of light hydrocarbons in FCC vapor recovery units, processes wherein carbon dioxide is absorbed into solvent, and ethylene absorption into solvents or lean oils. The cost of hot utilities for absorption processes is significant in the stripping of undesired components in bottom stream. The present invention improves the opportunity to recover not only the heat of the column's own bottom stream, but also the opportunity use rejected heat from other process streams. For some absorption processes, such as demethanization of a hydrogen- and ethylene-containing cracked gas stream, the absorption column has been adapted to contain a stripping section below an absorption section. The present invention will be advantageously used in that system to exchange heat between the regenerator and absorption columns according to desired optimization.

TABLE 1

Conventional Deethanizer

| Stream | 101 | 102 | 103 | 104 | 105 | 106 | 107 | 108 |
|---|---|---|---|---|---|---|---|---|
| Vap. Frac. | 0.0000 | 0.0000 | 0.0000 | 1.0000 | 0.0000 | 0.0000 | 0.0000 | 0.1790 |
| Deg. F. | 85.0 | 84.8 | 132.5 | 56.1 | 233.0 | 172.2 | 162.2 | 170.8 |
| psia | 564.7 | 460.0 | 455.0 | 449.3 | 457.1 | 452.1 | 455.6 | 456.1 |
| lbmole/hr | 15,803 | 15,803 | 15,803 | 6,398 | 9,405 | 9,405 | 26,967 | 26,967 |
| Mlb/hr | 708.41 | 708.41 | 708.41 | 193.52 | 514.89 | 514.89 | 1245.85 | 1245.85 |
| barrel/day | 100,000 | 100,000 | 100,000 | 36,785 | 63,215 | 63,215 | 169,932 | 169,932 |
| Vol. Frac. | | | | | | | | |
| Methane | 0.0050 | 0.0050 | 0.0050 | 0.0136 | 0.0000 | 0.0000 | 0.0000 | 0.0000 |
| Ethane | 0.3700 | 0.3700 | 0.3700 | 0.9513 | 0.0317 | 0.0317 | 0.2283 | 0.2283 |
| Propane | 0.2600 | 0.2600 | 0.2600 | 0.0350 | 0.3909 | 0.3909 | 0.4437 | 0.4437 |
| i-Butane | 0.0720 | 0.0720 | 0.0720 | 0.0001 | 0.1139 | 0.1139 | 0.0776 | 0.0776 |
| n-Butane | 0.1480 | 0.1480 | 0.1480 | 0.0000 | 0.2341 | 0.2341 | 0.1437 | 0.1437 |
| i-Pentane | 0.0500 | 0.0500 | 0.0500 | 0.0000 | 0.0791 | 0.0791 | 0.0398 | 0.0398 |
| n-Pentane | 0.0350 | 0.0350 | 0.0350 | 0.0000 | 0.0554 | 0.0554 | 0.0268 | 0.0268 |
| n-Hexane | 0.0400 | 0.0400 | 0.0400 | 0.0000 | 0.0633 | 0.0633 | 0.0273 | 0.0273 |
| n-Heptane | 0.0200 | 0.0200 | 0.0200 | 0.0000 | 0.0316 | 0.0316 | 0.0128 | 0.0128 |
| Exchanger | E101 | E102 | E103 | E104 | | | | |
| MMBtu/hr | 24.49 | 49.40 | 72.66 | 25.48 | | | | |

TABLE 2

Partially Interreboiled Deethanizer

| Stream | 101 | 102 | 103 | 204 | 205 | 206 | 207 | 208 |
|---|---|---|---|---|---|---|---|---|
| Vap. Frac. | 0.0000 | 0.0000 | 0.0000 | 1.0000 | 0.0000 | 0.0000 | 0.0000 | 0.9748 |
| Deg. F. | 85.0 | 84.8 | 132.5 | 56.1 | 233.0 | 154.5 | 144.4 | 207.9 |
| psia | 564.7 | 460.0 | 455.0 | 449.3 | 457.0 | 452.0 | 455.4 | 456.1 |
| lbmole/hr | 15,803 | 15,803 | 15,803 | 6,398 | 9,405 | 9,405 | 5,597 | 5,597 |
| Mlb/hr | 708.41 | 708.41 | 708.41 | 193.52 | 514.90 | 514.90 | 248.72 | 248.72 |
| barrel/day | 100,000 | 100,000 | 100,000 | 36,784 | 63,216 | 63,216 | 35,000 | 35,000 |
| Vol. Frac. | | | | | | | | |
| Methane | 0.0050 | 0.0050 | 0.0050 | 0.0136 | 0.0000 | 0.0000 | 0.0000 | 0.0000 |
| Ethane | 0.3700 | 0.3700 | 0.3700 | 0.9513 | 0.0317 | 0.0317 | 0.3154 | 0.3154 |
| Propane | 0.2600 | 0.2600 | 0.2600 | 0.0350 | 0.3909 | 0.3909 | 0.3857 | 0.3857 |
| i-Butane | 0.0720 | 0.0720 | 0.0720 | 0.0001 | 0.1138 | 0.1138 | 0.0683 | 0.0683 |
| n-Butane | 0.1480 | 0.1480 | 0.1480 | 0.0000 | 0.2341 | 0.2341 | 0.1285 | 0.1285 |
| i-Pentane | 0.0500 | 0.0500 | 0.0500 | 0.0000 | 0.0791 | 0.0791 | 0.0372 | 0.0372 |
| n-Pentane | 0.0350 | 0.0350 | 0.0350 | 0.0000 | 0.0554 | 0.0554 | 0.0253 | 0.0253 |
| n-Hexane | 0.0400 | 0.0400 | 0.0400 | 0.0000 | 0.0633 | 0.0633 | 0.0267 | 0.0267 |
| n-Heptane | 0.0200 | 0.0200 | 0.0200 | 0.0000 | 0.0316 | 0.0316 | 0.0128 | 0.0128 |
| Exchanger | E101 | E202 | E203 | E204 | | | | |
| MMBtu/hr | 24.49 | 49.28 | 66.13 | 31.87 | | | | |

TABLE 3

Partially Interreboiled Deethanizer
Two Interreboilers in Series

| Stream | 101 | 102 | 103 | 304 | 305 | 306 | 307 | 308 | 309 | 310 | 311 |
|---|---|---|---|---|---|---|---|---|---|---|---|
| Vap. Frac. | 0.0000 | 0.0000 | 0.0000 | 1.0000 | 0.0000 | 0.0000 | 0.0000 | 0.0000 | 0.9153 | 0.0000 | 0.3485 |
| Deg. F. | 85.0 | 84.8 | 132.5 | 56.1 | 233.7 | 168.6 | 137.9 | 148.6 | 206.7 | 127.9 | 147.8 |
| psia | 564.7 | 460.0 | 455.0 | 449.3 | 459.5 | 454.5 | 449.5 | 455.7 | 456.4 | 455.0 | 455.7 |
| lbmole/hr | 15,803 | 15,803 | 15,803 | 6,398 | 9,405 | 9,405 | 9,405 | 5,092 | 5,092 | 5,786 | 5,786 |
| Mlb/hr | 708.41 | 708.41 | 708.41 | 193.52 | 514.88 | 514.88 | 514.88 | 229.50 | 229.50 | 248.52 | 248.52 |

TABLE 3-continued

| | Partially Interreboiled Deethanizer Two Interreboilers in Series | | | | | | | | | | |
|---|---|---|---|---|---|---|---|---|---|---|---|
| Stream | 101 | 102 | 103 | 304 | 305 | 306 | 307 | 308 | 309 | 310 | 311 |
| barrel/day | 100,000 | 100,000 | 100,000 | 36,786 | 63,214 | 63,214 | 63,214 | 32,000 | 32,000 | 36,000 | 36,000 |
| Vol. Frac. | | | | | | | | | | | |
| Methane | 0.0050 | 0.0050 | 0.0050 | 0.0136 | 0.0000 | 0.0000 | 0.0000 | 0.0002 | 0.0002 | 0.0014 | 0.0014 |
| Ethane | 0.3700 | 0.3700 | 0.3700 | 0.9513 | 0.0317 | 0.0317 | 0.0317 | 0.2990 | 0.2990 | 0.4006 | 0.4006 |
| Propane | 0.2600 | 0.2600 | 0.2600 | 0.0350 | 0.3909 | 0.3909 | 0.3909 | 0.3809 | 0.3809 | 0.3101 | 0.3101 |
| i-Butane | 0.0720 | 0.0720 | 0.0720 | 0.0001 | 0.1138 | 0.1138 | 0.1138 | 0.0724 | 0.0724 | 0.0638 | 0.0638 |
| n-Butane | 0.1480 | 0.1480 | 0.1480 | 0.0000 | 0.2341 | 0.2341 | 0.2341 | 0.1372 | 0.1372 | 0.1224 | 0.1224 |
| i-Pentane | 0.0500 | 0.0500 | 0.0500 | 0.0000 | 0.0791 | 0.0791 | 0.0791 | 0.0401 | 0.0401 | 0.0367 | 0.0367 |
| n-Pentane | 0.0350 | 0.0350 | 0.0350 | 0.0000 | 0.0554 | 0.0554 | 0.0554 | 0.0274 | 0.0274 | 0.0251 | 0.0251 |
| n-Hexane | 0.0400 | 0.0400 | 0.0400 | 0.0000 | 0.0633 | 0.0633 | 0.0633 | 0.0289 | 0.0289 | 0.0269 | 0.0269 |
| n-Heptane | 0.0200 | 0.0200 | 0.0200 | 0.0000 | 0.0316 | 0.0316 | 0.0316 | 0.0139 | 0.0139 | 0.0130 | 0.0130 |
| Exchanger | E101 | E302 | E303 | E304 | E305 | | | | | | |
| MMBtu/hr | 24.49 | 49.05 | 60.21 | 27.14 | 10.76 | | | | | | |

I claim:

1. A process for interreboiling a column comprising:

(a) an interreboiler, connected to the column at draw and return stages in a stripping section of the column, to heat and return a column sidedraw;

(b) locating the draw stage of the interreboiler at least 2 theoretical stages above the return stage; and (c) interreboiling in the interreboiler during the operation of the column to effect indirect heat transfer from a stream of two or more components to a column stream from the draw stage and passing through the interreboiler.

2. The process of claim 1 wherein less than 10 theoretical stages are located between the draw and return stages in the column.

3. The process of claim 1 wherein the column produces a bottom stream that indirectly heats the interreboiler.

4. The process of claim 1 wherein the bottom stream provides all heating used in the interreboiler.

5. The process of claim 4 wherein the column is a deethanizer separating a feed consisting essentially of ethane, propane, isobutane, normal butane and gasoline range components.

6. The process of claim 5 wherein the column is operated at over about 200 psia.

7. The process of claim 6 wherein the temperatures of the process stream from the column in the interreboiler compared to the temperatures of the stream of two or more components in the interreboiler at each point of indirect heat transfer in the interreboiler are never more than about 30° F. apart.

8. The process of claim 4 wherein a heavy key component of the column feed is less than about 40 volume percent of the bottom stream.

9. A process for interreboiling a column comprising:

(a) a plurality of interreboilers, each connected to the column at draw and return stages in a stripping section of the column, wherein each heats and returns a column sidedraw;

(b) locating the draw stage of each interreboiler at least 2 theoretical stages above the return stage of that interreboiler;

(c) locating the draw and return stages so that no draw or return stage of one interreboiler is between the draw and return stage of any other interreboiler; and (d) interreboiling in the interreboilers during the operation of the column wherein in each interreboiler indirect heat transfer from a stream of two or more components heats a column stream from the draw stage respective to and passing through the interreboiler.

10. The process of claim 9 wherein less than 10 theoretical stages are located between the draw and return stages in the column for each interreboiler.

11. The process of claim 9 wherein the column produces a bottom stream that indirectly heats the interreboilers.

12. The process of claim 9 wherein the bottom stream provides all heating used in the interreboilers.

13. The process of claim 12 wherein the bottom stream first heats an interreboiler connected lowest in the column and then sequentially heats other interreboilers connected above the lowest interreboiler in the column.

14. The process of claim 12 wherein the column is a deethanizer separating a feed consisting essentially of ethane, propane, isobutane, normal butane and gasoline range components.

15. The process of claim 14 wherein the column is operated at over about 400 psia.

16. The process of claim 15 wherein, within each interreboiler, temperatures of the process stream from the column in the interreboiler compared to the temperatures of the stream of two or more components in the interreboiler at each point of indirect heat transfer in the interreboiler are never more than about 30° F. apart.

17. The process of claim 4 wherein a heavy key component of the column feed is less than about 40 volume percent of the bottom stream.

* * * * *